United States Patent [19]

Port et al.

[11] 4,123,577

[45] Oct. 31, 1978

[54] PRIMARY BACKING FOR TUFTED CARPETS AND CARPETS MADE THEREFROM

[75] Inventors: Morton I. Port, London, England; Juergen Nebe; Bernhard H. Ladeur, both of Gronau-Epe, Germany

[73] Assignee: Standard Oil Company (Indiana), Chicago, Ill.

[21] Appl. No.: 753,403

[22] Filed: Dec. 22, 1976

Related U.S. Application Data

[63] Continuation-in-part of Ser. No. 703,612, Jul. 8, 1976, abandoned.

[51] Int. Cl.[2] ..... B32B 5/02; B32B 5/06

[52] U.S. Cl. ..... 428/95; 156/297; 156/306; 156/322; 428/233; 428/236; 428/253; 428/286; 428/287; 428/288; 428/302

[58] Field of Search ..... 428/95, 233, 236, 253, 428/286, 287, 288, 302; 156/297, 306, 322

[56] References Cited

U.S. PATENT DOCUMENTS

| | | | |
|---|---|---|---|
| 2,444,115 | 6/1948 | Reed | 428/95 |
| 3,554,852 | 1/1971 | Sugarman | 428/95 |
| 3,817,817 | 6/1974 | Pickens | 428/95 |
| 3,819,462 | 6/1974 | Starr | 428/95 |
| 3,904,455 | 9/1975 | Goldman | 428/233 |

*Primary Examiner*—Marion E. McCamish

*Attorney, Agent, or Firm*—Thomas J. Connelly; Arthur G. Gilkes; William T. McClain

[57] ABSTRACT

An improved primary backing for tufted carpets having excellent tuftability comprises a woven, nonwoven, or knitted substrate capable of being tufted to which a web of blended fibers is heat fused.

30 Claims, No Drawings

PRIMARY BACKING FOR TUFTED CARPETS AND CARPETS MADE THEREFROM

CROSS REFERENCE TO RELATED APPLICATIONS

This is a Continuation-in-Part of a copending application Ser. No. 703,612, filed July 8, 1976 (now abandoned).

BACKGROUND

1. Field of the Invention

This invention relates to primary backing for tufted carpets and carpets made therefrom.

2. Prior Art

A tufted carpet has at least two parts. The first is a primary backing and the second is tufted pile loops which usually pass through and are supported by said primary backing. In a tufted carpet, pile loops either cut or uncut project from one side and are usually connected by loops on the reverse or floor side.

Fine gauge tufting in the art implies tufting with about 10 or more tufting needles per inch in the weft direction. Fine gauges generally run from about 1/10 to about 1/20 inch, wherein in the weft direction 1/10 inch corresponds to 10 tufting needles per inch and 1/20 inch corresponds to 20 tufting needles per inch. Pile heights, deniers, and stitches per inch in the warp direction so vary from style to style, that no exhaustive correlation to fine gauge tufting can be made. Generally, in fine gauge tufting, pile heights are in the range from 3 mm to about 15 mm; pile deniers are in the range 75 tex to about 250 tex, but texes as high as about 300 are not unknown, and stitches per inch in the warp direction are in the range of about 8 to about 20. As the gauges become finer and pile heights shorter, any discontinuities arising from either needle or tape deflection become aesthetically very noticeable.

Woven-tape or woven slit film substrates such as disclosed in T. M. Rhodes (cited later) modified to include multifilament weft fibers give rise to an improved primary backing for use in fine gauge tufted carpets. However, many aesthetic problems arising from insufficient pile uniformity still occur. The stability of the tufted substrate is generally not sufficient to avoid bowing and skewing during dyeing or applying a foam backing. It is to be noted that distortion of the dyed image in fine gauge tufted carpets generally has a more critically adverse impact on the aesthetic appearance of said carpet than in other types of tufted carpets.

It is to be noted that attempts to stabilize the woven substrate by the application of adhesives so as to overcome the above cited problems often has an adverse impact on the tufted process and for that reason have been generally unsuccessful.

With the advant of synthetic primary backing such as disclosed by H. A. Schwartz et al. in U.S. Pat. No. 3,359,934 (1967) and by T. M. Rhodes in U.S. Pat. No. 3,110,905 (1963), the dyeability of the primary backing in general, and those made from polyolefins, such as polypropylene and polyethylene resins and the like in particular, has become a concern. The reason for this concern is that if the substrate is not dye-compatible with the pile fibers, i.e. does not accept the same dyestuffs as the pile fibers, then the substrate will shadow light and detract from the overall light reflectance desired. Also the carpet will lack the desired uniform coloration and pattern clarity after pattern deep dyeing.

For purposes of discussion, both of these undesirable aspects of a substrate which is not dye-compatible with the pile loops will be referred to as "grinning" problems.

Of the many methods tried to solve grinning problems, only needlebonding of a fiber dye-compatible with the pile loops in sufficient quantities to form a thin subsurface of fibers which visually covers said substrate has had widespread commercial success. The method of needlebonding a substrate is disclosed by R. H. Kimmel, et al. in U.S. Pat. No. 3,605,666 (1971). A primary backing made by this process of needlebonding will throughout this Specification be referred to as an FLW primary backing. FLW are initials for fiber lock weave. It is to be noted that the reason for using different types of fibers for the substrate from those used in the pile loops is dictated by commercial considerations, in that the dyeable pile loops generally are much more expensive than the material used to form the substrate of the primary backing.

There are however several disadvantages to both the manufacture and performance of FLW primary backing. These are: (1) production speeds for the needling process are very adversely affected by decreasing fiber deniers, increasing web weights, and increasing number of needle punctures/inch and also there is a substantial amount of noise associated with the needling process; (2) some of the effective covering power of the needled fibers is lost due to a portion of the needled fibers projecting through to the back of the substrate; (3) there is a tendency for some of the fleece fibers to work their way out of the FLW primary backing (fiber bleeding) with adverse affects on the performance and appearance of the finished carpet; (4) even though a greater cover power/web weight of pigmented, dyed or dye-compatible fibers occurs with increasingly fine deniered or low cross-sectional area fibers, in practice the cross-sectional area of the fibers in the needling process are limited, because the finer the fiber the slower is the process of needlebonding; (5) tuft lock (as measured according to ASTM D 1335-67) is reduced in a primary backing material which has been needled prior to tufting; and (6) the overall tensile strength of a tufted primary backing is reduced by the needlebonding process.

It is an object of this invention in some of its embodiments to provide a primary backing for fine gauge tufted carpets which overcomes many of the above described problems associated with fine gauge tufting.

It is an object of this invention to provide a method and article of manufacture suitable for primary backing for tufted carpets and carpets made therefrom which obviate the limitations associated with FLW primary carpet backings and their method of manufacture.

It is an object of this invention to provide an article suitable as a primary backing for tufted carpets which uses substantially less dyeable, pigmented, or dyed subsurface or fleece fibers than an FLW primary backing to achieve an equal degree of visual cover or cover factor.

It is an object of this invention to provide a primary backing for tufted carpets wherein the subsurface fibers have both a higher peel strength and substantially less tendency to fiber bleed than those found in FLW primary backing.

It is an object of this invention to provide a primary backing for tufted carpets which has higher overall tensile strength subsequent to a tufting and/or dyeing operation than an FLW backing.

Other objects will be clear to a man of skill in the art after reading this Specification.

BRIEF DESCRIPTION OF THE INVENTION

It has been found that the above objects can be accomplished by a method comprising forming a web or fleece of fibers on a woven, non-woven, or knitted substrate by means of conventional web-forming machinery such as is obtainable from Hergeth AG, Maschinenfabrik und Apparatebau Duelmen FRG, wherein said web is heat fusible to said substrate, and heat fusing said web to said substrate. Heat fusible throughout this Specification and Claims is defined to mean capable of forming a bond under the influence of both heat and pressure. The web generally consists of a blend of two fiber components, the first, which can at least in part be dyed, dyeable, coated, pigmented, or the like, is heat fusible to said substrate at a temperature which is equal to or below the heat or melt fusion temperature of the substrate and which is beneficially also below and preferably at least about 5° F. below the melting point (as determined according to ASTM D 2117-64) of a second fiber component in the blend. The second fiber component is preferably at least in part dye-compatible with tufted pile loops which are later to be introduced to form a tufted carpet. The second fiber component can also be at least in part a dyeable or pigmented fiber not itself melt or heat fusible to said substrate. The first fiber component provides either the bonding of the second fiber component in the web to said substrate and/or in addition to and/or in the absence of the second fiber component, color coverage to the substrate. Component is throughout this Specification and Claims intended to indicate the possibility of one or more different fibers of the same class, i.e. either heat fusible with a substrate, an example of a fiber in a first fiber component, or not heat fusible with a substrate, an example of a fiber in a second fiber component.

Methods for preparing a dyeable fiber, such as for example a polyolefin fiber, by means of incorporating therein a dye receptive additive are given in U.S. Pat. Nos. 3,819,758 (1974); 3,834,870 (1974); 3,820,949 (1974); and 3,926,553 (1975). Each is incorporated herein by reference.

Methods for preparing a pigmented fiber, such as for example a pigmented polyolefin fiber are well known in the art.

It is to be noted that generally the substrate alone is capable of being tufted and the weight per square meter of the fiber web bonded to said substrate will be preferably as small a weight as possible and still provide as much dimensional stability as required in subsequent steps of carpet manufacture as well as sufficient coverage to avoid significant grinning problems. Generally, said fiber web will not be tuftable unless bonded to said substrate. A substrate which alone is not capable of being tufted must become so capable after a fiber web has been bonded thereto.

In general, the greater the weight percent of bonding fiber based upon total web weight, the greater will be the peel strength. The denier and length of the fibers within the web are in part limited by the problem of cloudiness which is descriptive of the non-uniformity of a carded web as is known in the web forming art. Fiber lengths substantially greater than 150 mm can be used provided that sufficiently large deniers are used. As the denier of a fiber approaches 1.2 dtex, and its length becomes increasingly longer than 150 mm, cloudiness becomes an increasingly larger problem.

A method for producing an article suitable for use as a primary backing for carpets having tufted pile loops comprises:

(1) forming a web onto a woven, nonwoven, or knitted substrate capable of being tufted with pile loops ranging from coarse to fine in both denier and gauge, wherein said web comprises about 5% to 100%, and preferably, about 15% to 100% by weight based on the total weight of the web of a first fiber component which is heat or melt fusible to said substrate and can be at least in part dyeable, pigmented or dyed and which has a denier of at least about 1.2 dtex and a fiber length of at least 5 millimeters, and about 95% to 0.0%, and preferably, about 85% to 0.0% by weight, based on the total weight of the web, of a second fiber component which can at least in part be either dye-compatible with said tufted pile loops, dyeable, or pigmented and which has a denier of at least about 1.2 dtex and has a fiber length of at least 5 millimeters;

(2) applying heat and pressure so as to produce both a bond between said first fiber component and said substrate, and, where a second fiber component is used, a bond between said first fiber component and said second fiber component, whereby said web is bonded to said substrate.

Web weights in general are preferably as low as possible, while achieving sufficient dimensional stability as well as coverage to avoid substantial grinning problems. A web weight per square meter of at least 3 g is usually necessary. Web weights per square meter found satisfactory are generally in the range of about 3–70 grams, and preferably in the range of 5–50 grams.

The gram ranges in web weight per square meter for commercial FLW backing are about 33 to about 135 grams. The web weight to achieve a particular level of coverage clearly depends in part upon the deepness of the color from the dye or pigment used in the fibers present in the web. In view of the enhanced coverage achievable by means of this invention, over FLW, particular advantages accrue from use of web weights below about 25 grams per square meter.

Said second fiber component comprises fibers which are not heat fusible to said substrate, so that only bonds between said first fiber component and said second fiber component can occur.

In general, any substrate, woven, non-woven, or knitted capable of being tufted to which heat fusible thermoplastic fibers can be heat and pressure bonded can be used. Examples of thermoplastic substrates useful in this invention are in general polyolefins, polyamides, polyesters, vinyls, and acrylates.

Woven substrates having fibers preferably flat and rectangular in cross-section of 200 to 1500 dtex in both the warp and weft with 10 to 30 counts per inch in the warp and 5 to 30 counts per inch in the weft are particularly useful. An example of such woven substrates can be found in T. M. Rhodes. In the case of fine gauge tufted carpets, said woven substrates preferably employ multifilament yarn having single filaments between about 2 and about 20 dtex with round or multilobal cross-section. The multifilament yarn preferably has a producer's twist of about 10 to 20 turns per meter. It has been found that the fine gauge tuftability can in general be improved by heat fusing a layer of fibers to said substrate, and a particularly useful primary backing for fine gauge tufted carpets can be made by means of this invention.

One method for applying heat and pressure is to use a nip created between two counter-rotating rolls. The roll contacting a side of said substrate covered with a fiber web is heated to a temperature sufficient to cause heat fusion between the first fiber component, i.e., the heat fusible fiber component, and the substrate, and if there is a second fiber component present, to cause a bond between said first fiber component and said second fiber component without severely softening said second fiber component, i.e., said temperature is below and preferably at least 5° F. below the melting point of said second fiber component. If for example a polyamide-6 fiber and a fiber and a substrate of polypropylene or other polymer made from one or more 1-olefins having up to 8 carbon atoms or the like are being used, then said temperature is in the range of about 160° C. to 200° C., i.e., the melt fusion temperature range for polypropylene. The other of said counter-rotating rolls contacts the uncovered side of the substrate and is heated to a temperature in the range of about 0° to 160° C., and the linear pressure in said nip can be up to about 350 Kp per linear centimeter. The linear rate of speed of said substrate in the machine direction through said nip is in a range of up to about 60 meters per minute.

Several arrangements involving both plain or embossed rolls can be employed to form said nip. In a first arrangement, a plain steel or chromium plated roll contacts a side of the substrate covered with a fiber web or fleece and either an embossed roll or a plain roll with a flexible or deformable surface contacts the uncovered side of said substrate. An example of such a deformable surface is one covered with cotton paper. In this first arrangement, pressures preferably range from about 180 Kp/linear cm. to about 300 Kp/linear cm. With a pressure much below 180 Kp/cm., the fiber web does not adhere well to the substrate, but with a pressure much above 350 Kp/cm., the substrate can be adversely affected. In a second arrangement, an embossed roll contacts a side of the substrate covered with a fiber web or fleece and the opposite side is contacted with either a plain steel roll or one having a deformable surface, such as for example a cotton-paper surface. In the second arrangement, pressures preferably range from about 20 Kp/linear cm. to about 180 Kp/linear cm. With a pressure much below 20 Kp/linear cm., the fiber web does not adhere well to the substrate, but with a pressure much about 180 Kp/linear cm., the substrate can be adversely affected. In general, the number of bosses of the embossed roll in both arrangements is in the range of about 20-80 bosses/cm.$^2$ and preferably about 30-50 bosses/cm.$^2$ providing an effective embossed area of about 10-50% and preferably 20-40% of the primary backing surface.

Generally, in the second arrangement, the greater the number of bosses/cm$^2$, the higher will be the peel strength of the fleece or web on the substrate, all other factors such as fleece or web weight on the substrate, linear pressure and temperature of the calender rolls, and linear rate of speed of substrate in the machine direction being held constant. Further, the main considerations for the optimum height of bosses are the effect of various heights on the rates of wear to bosses as is readily understood by those skilled in the calendering art. When a roll with a non-deformable surface such as with a chrome plated roll is used opposite to said embossed roll there is a tendency with decreasing heights of bosses for calendered webs to stick to the embossed calender roll rather than readily separating therefrom during processing. However, when a deformable roll such as one clad with cotton-paper is used, then there is a substantial reduction in this sticking tendency to the point where it does not interfere in processing.

The temperature of the calender rolls will in part depend upon the specific heat and thermal conductivity of the fleece or web, and its weight/meter$^2$, and the speed of the substrate through the nip in the machine direction. If the web is heavier, higher temperature and slower speeds are generally preferred. In general, higher temperatures tend to permit faster rates of the substrate in the machine direction.

It is important to note however, that whereas the speed of the needling process is greatly affected by fiber deniers and/or web weights, the speed of the calendering process is not substantially affected by fiber deniers and/or web weights.

Other heating methods which can be used in conjunction with pressure to achieve bonding of a web to a substrate are infrared radiation, ultrasonic, magnetic, and dielectric heating of appropriate coatings and/or fiber constituents.

Primary backings made by the above described methods show excellent tuftability with a pile weight in the range 150 to 2,000 grams/meter$^2$, and a height in the range 3 to 30 mm. Further, the speed to form a primary backing of this invention is in general faster, and in the situations wherein webs of fine denier fibers are used, is substantially faster than the speed to form an FLW primary backing.

It has been found that for a given substrate and tufted pile loop that the tuft lock for the primary backing of this invention is substantially greater than the tuft lock obtainable in an FLW primary backing.

It has been found that to achieve the same cover factor with dye-compatible fibers in a primary backing of this invention as compared to an FLW primary backing that only half of the weight of the dye-compatible fibers in the fleece or web are necessary.

The web is formed on said substrate by conventional web forming means such as for example, a conventional carding machine which can apply a unidirectional fleece or a randomly oriented fleece by a random card as in the case of a Fehrer K 12, or a cross-lapped web made by layering in a moving conveyor system.

Subsequent to forming the web on the substrate, the material is fed into a calender which is at a temperature which largely depends upon the melting point (ASTM D 2117-64) of the heat fusible fiber contained in said web. It will normally be lower than about 300° C. and has to be closely controlled to avoid the tendency of the web to wrap around the heated rolls. More specifically the materials with a low softening point can be calendered in rolls having a temperature of about 150° C. The pressure of the calender should preferably be designed to allow for linear pressures of up to about 350 Kp/linear cm. Problems from static electricity build up can be avoided by treating the web with moisture during processing and/or maintaining a relative humidity in the downstream area of about 60%.

DETAILED DESCRIPTION OF THE INVENTION

EXAMPLE 1 OF A METHOD FOR MAKING A PRIMARY BACKING OF THIS INVENTION

A fleece or web having a weight of 20 g/m$^2$ composed of 30% by weight polypropylene fiber having a denier of 3.1 dtex, a length of 60 millimeters and having a dull finish, and 70% by weight polyamide fiber having a denier of 3.5 dtex, a length of 60 millimeters and a dull finish was prepared in a carding line from Hergeth which consists of a bale opener type MBL, a fore-opener, a material transport ventilator type TV 300, a feeder-control, a vibrachute type DS, a compact card type JK, and an edge remover. The intrinsic viscosity with a Ubbelohde viscosimeter in a concentration range between 1 gram and 62.5 milligrams/100 ml. of solvent of the polyamide fiber determined according to ASTM D 789 at 20° C. was 57 ml/g. in m-cresol, and 35 ml/g. in 90% formic acid. The melt flow of the polypropylene determined according to a modified version of ASTM D 1238 was 13 g/10 mins. at 190° C. and 2.16 Kp of force. The fleece composed of these fibers was conveyed to the upper nip of a three-roll multipurpose calender (Type RKK 340 from Ramisch Kleinewefers) where said fleece is distributed onto a woven polypropylene of the style number 2400 sold by Patchogue Plymouth. Style 2400 is a plain weave of 24 counts/inch in the warp and 11 counts/inch in the weft, having a weight/yard$^2$ of 3.18. The denier of the warp fiber is 525, and that of the weft fiber is 1050. The upper roll of this calender is provided with an embossing pattern number FL 105 S sold by Ramisch Kleinewefers Kalander GmbH, 415 Krefeld, and the middle roll is a plain steel roll. The rolls are heated with a stream of hot oil at a regulated pressure and in the case here the upper roll had a temperature of 195° C. and the middle roll had a temperature of 130° C. The composite structure was embossed at a pressure of 80 daN/cm. and processed at a speed of 14 m/min.

EXAMPLE 2 OF PEEL STRENGTH

The adhesion of the fiber fleece to the substrate (determined according to a modified version of the test procedure given by DIN 53530) gave a value of 3 N as compared to the adhesion found for the fiber fleece in an FLW primary backing which have a value of close to 2 N.

The modified portion of the test is to apply an adhesive tape such as sold by Beiersdorf AG, Hamburg, which is subsequently rolled twice with a metal roller of 4.2 Kg having a width larger than the specimen. The specimen is trimmed at each edge to give a width of 50 mm. The fleece with the adhesive paper on top is separated from the base cloth. The base cloth then is clamped in the stationary jaw, and the ply consisting of the fleece and the adhesive paper are clamped in the moving jaw of a tensile tester described in DIN 51221. It is then tested according to DIN 53530 with analysis according to DIN 53357.

EXAMPLE 3 CONCERNING TUFT LOCK AND TUFTABILITY

A piece of the backing 10 meters long and one meter wide prepared by the above precedure was tufted. The loop pile had a two ply of 1260 dtex fiber made from 100% nylon 6 with a ¼ inch pile height and 5/32 of an inch gauge and a pile weight of about 520 g/m$^2$. The tuftability of this product was visually determined to be excellent by two technicians making independent observations.

Tuft lock according to a slightly modified version of ASTM D 1335–67, i.e. using only a tufting clamp and loop hook, but not a cylindrical specimen holder of the cut away type, was measured for an FLW primary backing and the backing made according to the example of a method for making a primary backing of the invention. Each primary backing was tufted under the same conditions with the same pile yarn as described above. A value of 85 cN was found in the case of the tufted FLW primary backing, and a value of 140 cN was found in the case of the tufted primary backing of this invention.

EXAMPLE 4 OF TENACITY OF A TUFTED CARPET MADE WITH FLW BACKING OF THIS INVENTION

Samples of primary backing of style 2400 are both made into a primary backing by the process given in Example 1 of a method for making a primary backing of this invention and needlebonding to form an FLW primary backing. Two different tufting operations are subsequently employed on each. One involving 8 stitches/inch and the other 6.5 stitches/inch. The pile loops have a gauge of 5/32 of an inch, are 2 ply of 1260 denier polyamide-6. The tufted carpet is subsequently dyed by a winch dyeing process prior to a determination of tensile strength in the warp and weft directions. Results in decanewtons, daN, are tabulated hereinafter.

| Direction | Poly Bac (Reg. TM) 2400 | FLW As Finished | FLW After Tufting | Product of Invention As Finished | Product of Invention After Tufting |
|---|---|---|---|---|---|
| Warp | 100 | 42 | 40* | 50 | 46* |
| Weft | 76 | 56 | 26* | 64 | 29* |
| Warp | 100 | 42 | 42** | 50 | 48** |
| Weft | 76 | 56 | 23** | 64 | 27** |

*Tufted with 6.5 stitches/inch.
**Tufted with 8 stitches/inch.

EXAMPLE 5 OF PIGMENTED POLYPROPYLENE USED IN THE PRIMARY BACKING OF THIS INVENTION

A 70 parts Amoco 5013 polypropylene to 1 part of 35% by weight of carbon black in polypropylene, D 1937 sold by Hercules, was melt blended and extruded and oriented into fibers having a denier of 3.1 dtex.

A fiber web of 25 parts of the above pigmented polypropylene to 75 parts of the above unpigmented polypropylene fiber each having a denier of 3.1 dtex and a length of 60 millimeters was formed on style number 2400 and fused thereto by the method disclosed under Example 1 of a method for making a primary backing of this invention.

The results were satisfactory.

EXAMPLE 6 OF A DYEABLE POLYPROPYLENE USED IN THE PRIMARY BACKING OF THIS INVENTION

A fiber made from a composition comprising 2% by weight of poly[1,3-di-(4-piperidyl) propane adipa id based upon the weight of Amoco 5013 polypropylene was used in the same manner as the pigmented polypro pylene in previous examples.

The primary backing was tufted and dyed by immersion in an aqueous solution containing as the sole dyestuff, 0.5 weight percent Terasil Blue BGL (C.I. Disperse Blue 73), 2 weight percent wetting agent, and sufficient formic acid to result in a pH of 5 at a 50:1 liquor ratio.

The carpet was placed in a bath at 50° C. The bath was raised to the boiling point, and held there for 1 hour. The carpet was then rinsed, and secured in aqueous 2 percent wetting agent for 15 minutes at 50° C.

The results were satisfactory.

EXAMPLE 7 OF PRIMARY BACKING USING WEIGHT RATIOS OF FIBERS

Primary backing for tufted carpets have been made by the process under Example 1 of a method for making primary backing of this Invention and are given in the following Table:

| Weight of Substrate | | Weight of Web | | Ratios by Weight | |
|---|---|---|---|---|---|
| g/m² | oz/sq.yd. | g/m² | oz/sq.yd. | Polyamide-6 | Polypropylene |
| 48 | 1.42 | 20 | 0.59 | 7 | 3 |
| 110 | 3.24 | 20 | 0.59 | 7 | 3 |
| 250 | 7.37 | 20 | 0.59 | 7 | 3 |
| 600 | 17.70 | 20 | 0.59 | 7 | 3 |
| 110 | 3.24 | 20 | 0.59 | 9 | 1 |
| 110 | 3.24 | 20 | 0.59 | 7 | 3 |
| 110 | 3.24 | 20 | 0.59 | 5 | 5 |
| 110 | 3.24 | 20 | 0.59 | 3 | 7 |
| 110 | 3.24 | 20 | 0.59 | 1 | 9 |
| 110 | 3.24 | 20 | 0.59 | 0 | 10 |
| 110 | 3.24 | 8 | 0.24 | 7 | 3 |
| 110 | 3.24 | 12 | 0.35 | 7 | 3 |
| 110 | 3.24 | 16 | 0.47 | 7 | 3 |
| 110 | 3.24 | 20 | 0.59 | 7 | 3 |
| 110 | 3.24 | 25 | 0.74 | 7 | 3 |
| 110 | 3.24 | 30 | 0.89 | 7 | 3 |
| 110 | 3.24 | 40 | 1.18 | 7 | 3 |
| 110 | 3.24 | 50 | 1.48 | 7 | 3 |
| 110 | 3.24 | 20 | 0.59 | 7 | 3 |

EXAMPLE 8 OF A PRIMARY BACKING PARTICULARLY SUITABLE FOR FINE GAUGE TUFTED CARPETS

A heat fusible web of 25 grams/square meter is applied as disclosed in Example 1 onto both sides of a plain weave substrate in two subsequent calendering steps. The plain weave is 26 counts per inch in the warp by 11 counts per inch in the weft. The warp and weft fibers are both multifilament fibers of 500 dtex wherein each single filament is about 5 dtex and is round in cross-section and wherein there is a producer's twist of about 15 turns per meter. The web is composed of 100% by weight of a heat fusible fiber of polypropylene as disclosed in Example 6 having a denier of 3.1 dtex, and a length of 60 millimeters.

A bond between said web and said substrate is formed in the nip of two counter-rotating rolls. One of said two rolls contacting the web covered side is a chromium plated stainless steel roll at 185° C., and the other is a cotton-paper clad steel roll at 25° C. The cotton-paper is 75% cotton-paper, 15% linen and 10% wool, 120 mm thick, and has a hardness value of 70 shore D.

The finished primary backing for fine gauge tufted carpet is tuftable with pile loops which have a gauge of 5/64 of an inch and are 1 ply of 1260 denier polyamide-6.

The aesthetic appearance of a fine gauge tufted carpet with a fleece layer of heat fusible web bonded thereto is superior on two grounds to one made without said fleece: 1) there is substantially more uniformity to both pile height and pile density, and 2) grinning problems are substantially lessened.

The above examples are intended only to clarify the invention. Variations on them are apparent to one skilled in the art and are intended to be within the scope of the invention.

The invention which is claimed is:

1. An article suitable for use as a primary backing for tufted carpets comprising a substrate and a web having a weight per square meter of at least about 3 grams bonded thereto which web comprises about 5% to 100% by weight of a first fiber component which is heat bonded to said substrate and which has a denier of at least about 1.2 dtex and a fiber length of at least about 5 millimeters, and about 95% to 0.0% by weight of a second fiber component which is bonded to said first fiber component and which has a denier of at least about 1.2 dtex, and a fiber length of at least about 5 millimeters.

2. The article of claim 1, wherein the web weight per square meter is about 5 to 50 grams.

3. The article of claim 2, wherein the web weight per square meter is less than about 25 grams.

4. The article of claim 1, wherein said substrate is made from a polyolefin selected from the group consisting of a polymer made from one or more 1-olefins of up to 8 carbon atoms.

5. The article of claim 1, wherein said web is not capable of being tufted unless bonded to said substrate.

6. The article of claim 1, wherein at least a portion of said first fiber component is pigmented.

7. The article of claim 1, wherein at least a portion of said first fiber component is dyeable.

8. The article of claim 1, wherein at least a portion of said second fiber component is pigmented.

9. The article of claim 1, wherein at least a portion of said second fiber component is dyeable.

10. The article of claim 1, wherein said substrate is itself tuftable.

11. A tufted carpet made from the article of claim 1.

12. An article suitable for use as a primary backing for tufted carpets comprising a substrate and a web having a weight per square meter in the range of about 3 to 70 grams bonded thereto which web comprises about 5% to 100% by weight of a first fiber component which is heat bonded to said substrate and which has a denier in the range of about 1.2 to 30 dtex and a fiber length in the range of about 5 to 150 millimeters, and about 95% to 0.0% by weight of a second fiber component which is bonded to said first fiber component and which has a denier in the range of about 1.2 to 30 dtex, and a fiber length in the range of about 5 to 150 millimeters.

13. The article of claim 12, wherein said substrate is not capable of being tufted until said web is bonded thereto.

14. A tufted carpet made from the article of claim 12.

15. An article suitable for use as a primary backing for fine gauge tufted carpets comprising (i) a woven thermoplastic substrate, wherein at least in the weft direction a multifilament yarn having a multifilament denier in the range of about 200 to 1500 dtex and having a single filament denier in the range of about 2 to 20 dtex and wherein in the warp direction a yarn having a denier in the range of about 200 to 1500 dtex, and (ii) a web having a weight per square meter of at least 3 grams which web comprises about 5% to 100% by weight of a first fiber component which is heat bonded to said substrate and which has a denier of at least about 1.2 dtex and a fiber length of at least about 5 millimeters, and about 95% to 0.0% by weight of a second fiber component which is bonded to said first fiber component and which has a denier of at least 1.2 dtex and a fiber length of at least about 5 millimeters.

16. A tufted carpet made from the article of claim 15.

17. A process for producing an article suitable for use as a primary backing for carpets having tufted pile loops comprising:

(a) forming on a woven, nonwoven, or knitted thermoplastic substrate capable of being tufted, a web comprising about 5% to 100% by weight of a first fiber component and about 95% to 0.0% by weight of a second fiber component, wherein said first fiber component is heat fusible with said substrate and has a denier of at least about 1.2 dtex and a fiber length of at least about 5 millimeters, and wherein said second fiber component is not heat fusible with said substrate and has a denier of at least about 1.2 dtex and has a fiber length of at least about 5 millimeters; and without needlebonding (b) applying sufficient heat and pressre to form a stable bond between fibers of said web as well as between said web and said substrate.

18. The process of claim 17, wherein the web weight per square meter is about 5 to 50 grams.

19. The process of claim 18, wherein the web weight per square meter is less than about 25 grams.

20. The process of claim 17, wherein said heat and pressure are applied in a nip created between two counter-rotating rolls.

21. The process of claim 17, wherein at least a portion of said first fiber component is pigmented.

22. The process of claim 17, wherein at least a portion of said first fiber component is dyeable.

23. The process of claim 17, wherein at least a portion of said second fiber component is dye-compatible with said tufted pile loops.

24. The process of claim 17, wherein at least a portion of said second fiber component is dyeable.

25. The process of claim 17, wherein at least a portion of second fiber component is pigmented.

26. The process of claim 25, wherein said second fiber component has a melting point at least 5° F. above the heat fusion temperature of said first fiber component.

27. The process of claim 17, wherein said second fiber component has a melting point above the heat fusion temperature of said first fiber component.

28. The process of claim 17, wherein said woven thermoplastic substrate is made from flat tapes.

29. The process of claim 17, wherein said woven thermoplastic substrate has at least in the weft direction a multifilament fiber.

30. A process for producing an article suitable for use as a primary backing for carpets having tufted pile loops comprising:

(a) forming on a woven, nonwoven, or knitted thermoplastic substrate capable of being tufted, a web having a weight per square meter of about 3 to 70 grams, comprising about 5% to 100% by weight of a first fiber component and about 95% to 0.0% by weight of a second fiber component, wherein said first fiber component is heat fusible with said substrate and has a denier in the range of about 1.2 to 30 dtex and a fiber length in the range of about 5 to 150 millimeters, and wherein said second fiber component is not heat fusible with said substrate and has a denier in the range of about 1.2 to 30 dtex and has a fiber length in the range of about 5 to 150 millimeters; and without needlebonding (b) applying sufficient heat and pressure to form a stable bond between fibers of said web as well as between said web and said substrate.

* * * * *

UNITED STATES PATENT OFFICE
CERTIFICATE OF CORRECTION

Patent No. 4,123,577 Dated October 31, 1978

Inventor(s) Morton I. Port; Joergen Nebe; and Bernhard H. Ladeur

It is certified that error appears in the above-identified patent and that said Letters Patent are hereby corrected as shown below:

| Patent Col. | Patent Line | |
|---|---|---|
| 1 | 56 | "advant" should read --advent-- |
| 2 | 33 | "affects" should read --effects-- |
| 5 | 49 | "about" should read --above-- |
| 7 | 47 | "have" should read --gave-- |
| 11 | 25 | "pressre" should read --pressure-- |
| 12 | 7 | "of second" should read --of said second-- |

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*